US008894845B2

(12) United States Patent
Vann et al.

(10) Patent No.: US 8,894,845 B2
(45) Date of Patent: Nov. 25, 2014

(54) ALKALI METAL HYDROPROCESSING OF HEAVY OILS WITH ENHANCED REMOVAL OF COKE PRODUCTS

(71) Applicant: ExxonMobil Research & Engineering Company, Annandale, NJ (US)

(72) Inventors: Walter David Vann, Glenn Mills, PA (US); Daniel Paul Leta, Flemington, NJ (US); Jonathan Martin McConnachie, Annandale, NJ (US); Richard Alan Demmin, Highland Park, NJ (US); Douglas Wayne Hissong, Cypress, TX (US); William C. Baird, Jr., Baton Rouge, LA (US); Roby Bearden, Jr., Baton Rouge, LA (US); James Ronald Bielenberg, Houston, TX (US); Howard Freund, Neshanic Station, NJ (US); Chris Aaron Wright, Vienna, VA (US); Michael Francis Raterman, Doylestown, PA (US); James Ronald Rigby, Kingwood, TX (US); Brandon Thomas Stone, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 203 days.

(21) Appl. No.: 13/693,222

(22) Filed: Dec. 4, 2012

(65) Prior Publication Data

US 2013/0161234 A1 Jun. 27, 2013

Related U.S. Application Data

(60) Provisional application No. 61/567,894, filed on Dec. 7, 2011.

(51) Int. Cl.

| | |
|---|---|
| ***C10G 19/02*** | (2006.01) |
| ***C10G 19/08*** | (2006.01) |
| ***C10G 53/12*** | (2006.01) |

(52) U.S. Cl.

CPC ..... *C10G 53/12* (2013.01); *C10G 2300/202* (2013.01); *C10G 19/02* (2013.01); *C10G 19/08* (2013.01); *C10G 2300/308* (2013.01); *C10G 2300/302* (2013.01)

USPC ..... 208/227; 208/229; 208/208 R; 208/203

(58) Field of Classification Search

CPC .. C10G 19/02; C10G 19/08; C10G 2300/202; C10G 2300/302; C10G 2300/308; C10G 53/12

USPC ..... 208/89, 177, 189, 208 R, 208 M, 218, 208/227, 229

See application file for complete search history.

(56) References Cited

U.S. PATENT DOCUMENTS

| | | | |
|---|---|---|---|
| 3,051,645 | A | 8/1962 | Wilson et al. |
| 3,104,157 | A | 9/1963 | Kimberlin, Jr. et al. |

(Continued)

*Primary Examiner* — Walter D Griffin
*Assistant Examiner* — Derek Mueller
(74) *Attorney, Agent, or Firm* — Bruce M. Bordelon; Chad A. Guice

(57) ABSTRACT

Hydrocarbon feedstreams are desulfurized using an alkali metal reagent, optionally in the presence of hydrogen. Improved control over reaction conditions can be achieved in part by controlling the particle size of the alkali metal salt and by using multiple desulfurization reactors. The processes herein allow a simple and effective method for removing the majority of coke formed in the alkali metal reagent reactions with the hydrocarbon feedstreams. This makes it cost effective to run such processes at higher severities (which result in higher coke production) thereby resulting in increased amounts of valuable converted hydrocarbon product yields. The process improvements herein may also be used to increase total throughput through a unit due to the ability to effectively manage higher coke content in the reaction products.

40 Claims, 10 Drawing Sheets

(56) References Cited

U.S. PATENT DOCUMENTS

| | | | |
|---|---|---|---|
| 3,136,714 | A | 6/1964 | Gibson et al. |
| 3,164,545 | A | 1/1965 | Mattox |
| 3,354,081 | A | 11/1967 | Aldridge |
| 3,383,304 | A | 5/1968 | Mattox et al. |
| 3,442,797 | A | 5/1969 | Aldridge |
| 3,449,242 | A | 6/1969 | Mattox et al. |
| 3,835,033 | A | 9/1974 | Dugan et al. |
| 3,847,797 | A | 11/1974 | Pasternak et al. |
| 3,850,742 | A | 11/1974 | Dugan et al. |
| 3,852,188 | A | 12/1974 | Dugan et al. |
| 3,873,670 | A | 3/1975 | Dugan et al. |
| 3,876,527 | A | 4/1975 | Dugan et al. |
| 4,003,823 | A | 1/1977 | Baird, Jr. et al. |
| 4,003,824 | A | 1/1977 | Baird, Jr. et al. |
| 4,007,109 | A | 2/1977 | Baird, Jr. et al. |
| 4,007,111 | A | 2/1977 | Baird, Jr. |
| 4,087,348 | A | 5/1978 | Baird, Jr. et al. |
| 4,119,528 | A | 10/1978 | Baird, Jr. et al. |
| 4,127,470 | A | 11/1978 | Baird, Jr. et al. |
| 4,147,611 | A | 4/1979 | Miasek et al. |
| 4,147,612 | A | 4/1979 | Miasek et al. |
| 4,437,908 | A | 3/1984 | Inoue |
| 4,545,891 | A | 10/1985 | Meyers et al. |
| 4,566,965 | A | 1/1986 | Olmstead |
| 4,927,524 | A | 5/1990 | Rodriguez et al. |
| 5,059,307 | A | 10/1991 | Meyers et al. |
| 5,085,764 | A | 2/1992 | Meyers et al. |
| 5,508,018 | A | 4/1996 | Brons et al. |
| 5,626,742 | A | 5/1997 | Brons et al. |
| 5,635,056 | A | 6/1997 | Brons et al. |
| 5,695,632 | A | 12/1997 | Brons et al. |
| 5,871,637 | A | 2/1999 | Brons |
| 5,904,839 | A | 5/1999 | Brons |
| 5,935,421 | A | 8/1999 | Brons et al. |
| 6,180,072 | B1 | 1/2001 | Veal et al. |
| 2004/0069682 | A1 | 4/2004 | Freel et al. |
| 2004/0069686 | A1 | 4/2004 | Freel et al. |
| 2011/0147273 | A1 | 6/2011 | Soto et al. |
| 2011/0147274 | A1 | 6/2011 | Soto et al. |

ALKALI METAL HYDROPROCESSING OF HEAVY OILS WITH ENHANCED REMOVAL OF COKE PRODUCTS

CROSS-REFERENCE TO RELATED APPLICATIONS

This application claims the benefit of U.S. Provisional Application Ser. No. 61/567,894 filed on Dec. 7, 2011; which is incorporated herein in its entirety by reference.

FIELD OF THE INVENTION

The present invention relates to a process for conversion and/or desulfurization of heavy oil feedstreams utilizing alkali metal salts and the removal of coke from the process products.

BACKGROUND

Heavy oils and bitumens make up an increasing percentage of available liquid hydrocarbon resources. As the demand for hydrocarbon-based fuels has increased, a corresponding need has developed for improved processes for desulfurizing heavy oil feedstreams. Processes for the conversion of the heavy portions of these feedstreams into more valuable, lighter fuel products have also taken on greater importance. These heavy oil feedstreams include, but are not limited to, whole and reduced petroleum crudes including bitumens, shale oils, coal liquids, atmospheric and vacuum residua, asphaltenes, deasphalted oils, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, raffinates, and mixtures thereof.

Hydrocarbon streams boiling above 430° F. (220° C.) often contain a considerable amount of large multi-ring hydrocarbon molecules and/or conglomerated association of large molecules containing a large portion of the sulfur, nitrogen and metals present in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

Processing of bitumens, crude oils, or other heavy oils with large numbers of multi-ring aromatics and/or asphaltenes can pose a variety of challenges. Conventional hydroprocessing methods can be effective at improving API for a heavy oil feed, but the hydrogen consumption can be substantial. Conversion of the liquid to less valuable products, such as coke, can be another concern with conventional techniques.

One general method in the art for hydroprocessing of heavy oils by treating heavy oils with alkali metal salts is exemplified in U.S. Pat. No. 4,003,823. Here, is disclosed a process for treating heavy carbonaceous feeds in the presence of an alkali metal hydroxide and hydrogen to convert the heavy feed into lighter (higher API) hydrocarbon products. In a similar manner, U.S. Pat. No. 4,003,824 discloses a process for treating heavy carbonaceous feeds in the presence of an alkali metal hydride and hydrogen to convert the heavy feed into lighter (higher API) hydrocarbon products. In both of these processes, coke (solid, high carbon materials) are produced during the reactions and are present as contaminants in the products derived from such processes.

In these processes, the coke typically either ends up in the separated product oils or in the separated spent alkali metal salts stream. In either case, the coke must be removed from at least one of these product streams and in either case is difficult and expensive to facilitate such selective removal of the coke contaminants. Neither of these patent disclosures addresses methods for removing the coke from the product streams although such removal is necessary for operating an efficient and cost effective process. As such, it is generally recommended therein to limit the severity (i.e., conversion rate) of the process and thus minimize the coke in the products. This however, lowers overall throughput or reduces the amount of product produced by limiting the overall process conversion. Another manner in which to reduce coke make is to add excessive hydrogen (at higher hydrogen partial pressures) which will tend to reduce the total coke make in the process. However, the use of added/excess hydrogen is very costly and has limited benefits, and as such, is practice which is to be avoided by refiners if possible.

U.S. Patent Application Publication Nos. 2011/0147273 and 2011/0147274 also disclose processes for conversion of heavy hydrocarbon feeds into lower molecular weight products in the presence of alkali metal salts and hydrogen as well as processes for regenerating the spent alkali metal salts. However, similarly, the processes described in these applications do also result in coke being formed in the product streams and do not address efficient methods for removing such coke byproduct contaminants from either the oil or alkali metal product streams. Similar to as discussed above, it is recommended to minimize the coke produced in the process by limiting the severity of the process (including limiting the amount of time subjected to the reaction conditions) as well as utilizing a two-stage reactor system to allow processing flexibility for minimizing the coke produced in each stage.

What is needed in the industry is a process for effectively removing the coke products from alkali metal salts hydroconversion processes that is simple and inexpensive, thus allowing the hydroconversion reactions to be run at higher severity in order to produce higher amount of converted products with the same major process equipment.

SUMMARY OF THE INVENTION

The present invention relates to a process for conversion and/or desulfurization of heavy oil feedstreams and a simple, low-cost, efficient method for removing coke produced in the process from the product streams.

In an embodiment herein is a process for desulfurizing a hydrocarbon feedstream, comprising:

a) mixing at least a portion of a hydrocarbon feedstream having an API gravity of less than 19 with an aqueous alkali metal salt reagent solution to form a first mixed reactor feedstream;

b) exposing at least a portion of the first mixed reactor feedstream to a first desulfurization reactor operated under first effective desulfurization conditions to form a first desulfurized reactor product stream comprising desulfurized oil, spent alkali metals, and coke;

c) separating the first desulfurized reactor product stream to form at least a first low-boiling point vapor fraction and a first reactor product liquid fraction;

d) mixing at least a portion of the first reactor product liquid fraction with water to form a first wash water separator feedstream;

e) sending the first wash water separator feedstream to a first wash water separator vessel wherein in the first wash water separator vessel, the first wash water separator feedstream forms three distinct layers as flows; a first desulfurized oil product layer, a first emulsion phase layer, and a first aqueous spent alkali metal layer;

f) removing each of the three distinct layers separately from the first wash water separator vessel to separately form a first desulfurized oil product stream, a first emulsion phase stream, and a first aqueous spent alkali metal stream;

wherein at least 50 wt % of the total coke in the first desulfurized reactor product stream is removed in the first emulsion phase stream, and the first desulfurized oil product stream has a lower sulfur content by wt % than the hydrocarbon feedstream, and the first desulfurized oil product stream has a API gravity of at least 20 and a viscosity of less than or equal to 40 centistokes at 40° C.

In a preferred embodiment, the process further comprises:

heating the first mixed reactor feedstream to a temperature of at least 150° C.;

sending the heated first mixed reactor feedstream through a mixing device; and removing at least at least a portion of the water from the first mixed reactor feedstream prior to step b).

Preferably, the alkali metal salt reagent solution comprises $K_2S$, KHS, KOH or a mixture thereof; most preferably, the alkali metal salt reagent solution comprises KOH. Preferably, the effective desulfurization conditions for the desulfurization reactors are from about 50 to about 3000 psi (345 to 20,684 kPa), and from about 600° F. to about 900° F. (316° C. to 482° C.).

In another embodiment herein is a process for desulfurizing a hydrocarbon feedstream, comprising:

a) mixing at least a portion of a hydrocarbon feedstream having an API gravity of less than 19 with a first aqueous alkali metal salt reagent solution to form a first mixed reactor feedstream;

b) exposing at least a portion of the first mixed reactor feedstream to a first desulfurization reactor operated under first effective desulfurization conditions to form a first desulfurized reactor product stream comprising desulfurized oil, spent alkali metals, and coke;

c) separating the first desulfurized reactor product stream to form at least a first low-boiling point vapor fraction and a first reactor product liquid fraction;

d) mixing at least a portion of the first reactor product liquid fraction with a second aqueous alkali metal salt reagent solution to form a second mixed reactor feedstream;

e) exposing at least a portion of the second mixed reactor feedstream to a second desulfurization reactor operated under second effective desulfurization conditions to form a second desulfurized reactor product stream comprising desulfurized oil, spent alkali metals, and coke;

f) separating the second desulfurized reactor product stream to form at least a second low-boiling point vapor fraction and a second reactor product liquid fraction;

g) mixing at least a portion of the second reactor product liquid fraction with water to form a first wash water separator feedstream;

h) sending the first wash water separator feedstream to a first wash water separator vessel wherein in the first wash water separator vessel, the first wash water separator feedstream forms three distinct layers as flows: a first desulfurized oil product layer, a first emulsion phase layer, and a first aqueous spent alkali metal layer;

i) removing each of the three distinct layers separately from the first wash water separator vessel to separately form a first desulfurized oil product stream, a first emulsion phase stream, and a first aqueous spent alkali metal stream;

wherein at least 50 wt % of the total coke in the first and second desulfurized reactor product streams is removed in the first emulsion phase stream, and the first desulfurized oil product stream has a lower sulfur content by wt % than the hydrocarbon feedstream, and the first desulfurized oil product stream has a API gravity of at least 20 and a viscosity of less than or equal to 40 centistokes at 40° C.

In yet an embodiment herein is a process for desulfurizing a hydrocarbon feedstream, comprising:

a) mixing at least a portion of a hydrocarbon feedstream having an API gravity of less than 19 with an aqueous alkali metal salt reagent solution to form a first mixed reactor feedstream;

b) exposing at least a portion of the first mixed reactor feedstream to a first desulfurization reactor operated under first effective desulfurization conditions to form a first desulfurized reactor product stream comprising desulfurized oil, spent alkali metals, and coke;

c) separating the first desulfurized reactor product stream to form at least a first low-boiling point vapor fraction and a first reactor product liquid fraction;

d) mixing at least a portion of the first reactor product liquid fraction with water to form a first wash water separator feedstream;

e) sending the first wash water separator feedstream to a first wash water separator vessel wherein in the first wash water separator vessel, the first wash water separator feedstream forms three distinct layers as flows: a first desulfurized oil product layer, a first emulsion phase layer, and a first aqueous spent alkali metal layer;

f) removing each of the three distinct layers separately from the first wash water separator vessel to separately form a first desulfurized oil product stream, a first emulsion phase stream, and a first aqueous spent alkali metal stream;

g) mixing at least a portion of the first desulfurized oil product stream with water to form a second wash water separator feedstream h) sending the second wash water separator feedstream to a second wash water separator vessel wherein in the second wash water separator vessel, the second wash water separator feedstream forms three distinct layers as flows: a second desulfurized oil product layer, a second emulsion phase layer, and a second aqueous spent alkali metal layer;

i) removing each of the three distinct layers separately from the second wash water separator vessel to separately form a second desulfurized oil product stream, a second emulsion phase stream, and a second aqueous spent alkali metal stream;

wherein at least 50 wt % of the total coke in the first desulfurized reactor product stream is removed in the first and second emulsion phase streams, and the first and second desulfurized oil product streams each have a lower sulfur content by wt % than the hydrocarbon feedstream, and the first and second desulfurized oil product streams each have an API gravity of at least 20 and a viscosity of less than or equal to 40 centistokes at 40° C.

DETAILED DESCRIPTION OF THE INVENTION

Overview

Figure 1:
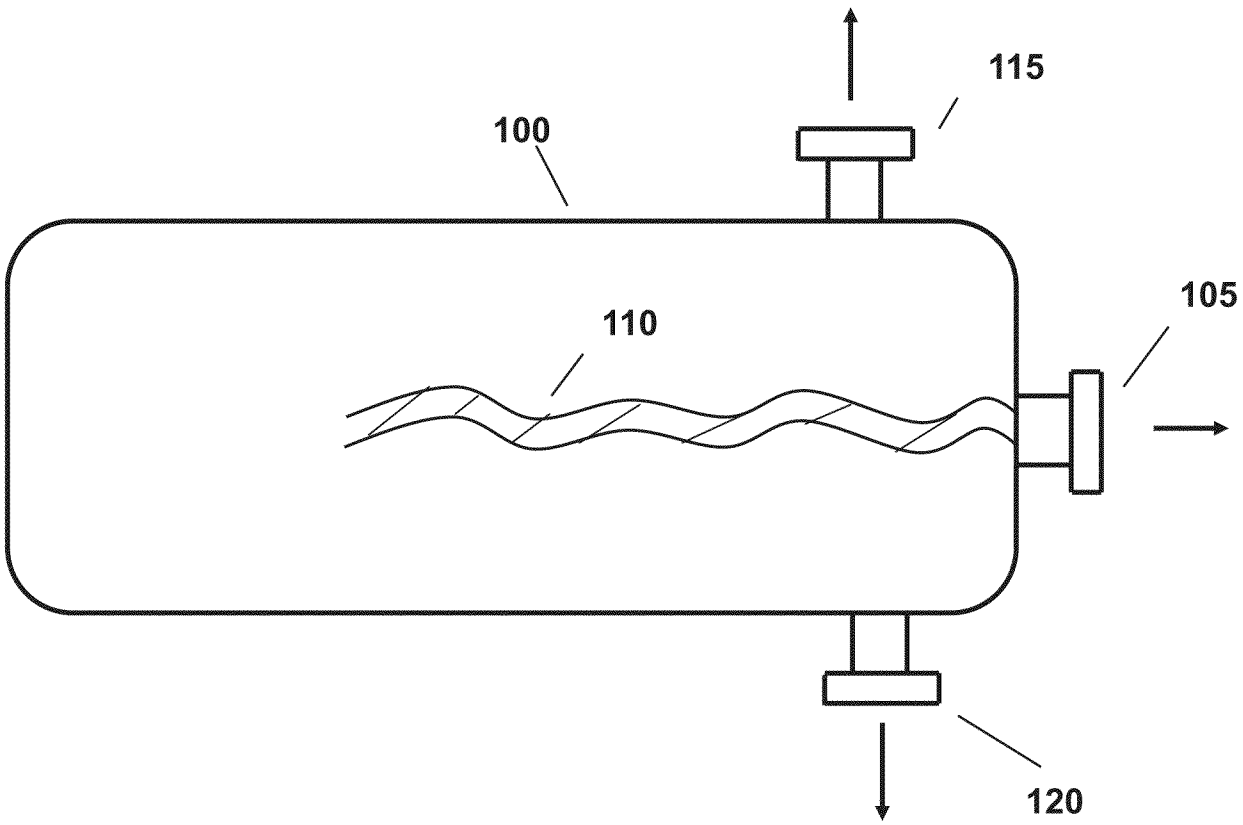
FIG. 1 illustrates a preferred embodiment of a wash water separator vessel and draw nozzle arrangement of invention for removing a separate desulfurized oil layer, aqueous spent alkali metal layer, and emulsion phase layer from the separator vessel.

In various embodiments, methods are provided for the conversion and desulfurization of heavy oil feeds using an alkali metal salt as a reagent and then separating the unwanted coke byproducts produced in such hydroconversion in a simple, cost effective manner.

Using an alkali metal salt as a reagent can provide a number of advantages over conventional processes. Relative to thermal conversion processes, an alkali metal salt desulfurization provides for improved liquid product yields and corresponding reduction in production of coke. Relative to conventional hydroprocessing, alkali metal salt processes have a reduced hydrogen consumption. Alkali metal salt desulfurization processes can also operate at lower temperatures and/or pressures, allowing for reduced capital and/or operating costs.

In addition to the above features, an alkali metal salt reagent desulfurization process can provide for improved levels of micro carbon residue in a desulfurized feed. Processing of heavy oil feeds typically results in creation of low value, solid products such as coke. Conventionally, the amount of low value, solid product created increases with the severity of the reaction conditions. In other words, more low value, solid product can form as more sulfur is removed and/or more conversion occurs of higher boiling to lower boiling molecules. Alkali metal salt reagent conversion/desulfurization processes can mitigate this creation of coke and other solids, however, coke is still a byproduct of these processes as ends up as a significant contaminant in the resulting product steams.

In these processes, the products are generally separated into a vapor offgas (such as lighter hydrocarbon gas, hydrogen, and hydrogen sulfide), and two liquid reaction product streams. The first of these liquid streams primarily contains the converted/desulfurized hydrocarbon products, and the other liquid stream primarily contains the spent alkali metal salts. Unfortunately, the coke produced in the process ends up in one of these two streams wherein it is difficult to remove. The unwanted coke byproducts produced however, need to be removed, as they will cause problems in the later processing steps of the converted oil stream (i.e., as equipment deposits or off-specification products), or in the later processing steps for regenerating the spent alkali metal salts. In order for such processes to be economical viable, the salts must be regenerated and returned to the process where any unremoved coke will deposit as a solid in the processing equipment.

As such, due to the absence of an effective method for removing the coke byproducts, most processers choose to operate at lower severity or higher hydrogen partial pressures in order to reduce the amount of coke byproducts, but these measures undesirably reduce the overall amount of valuable converted products and/or result in higher input costs, generally due to the use of additional hydrogen.

The alkali metal salt desulfurization and coke removal process described herein provides a variety of improvements for controlling process conditions and effectively removing coke byproducts from the system. As such, the processes herein can be run to higher severity levels thus maximizing the produced valuable lower molecular weight conversion products while easily removing the additional resulting coke that is produced at the higher severities.

Feedstocks

Various embodiments of the invention can be useful for desulfurization of "heavy oil feedstreams" or "heavy oil streams", which are used herein are equivalent. Heavy oil feedstreams or heavy oil streams are defined as any hydrocarbon-containing streams having an API gravity of less than 20. Preferred heavy oil feedstreams for use in the present invention include, but are not limited to low API gravity, high sulfur, high viscosity crudes; tar sands bitumen; liquid hydrocarbon streams derived from tar sands bitumen, coal, or oil shale; as well as petrochemical refinery heavy intermediate fractions, such as atmospheric resids, vacuum resids, and other similar intermediate feedstreams and mixtures thereof containing boiling point materials above about 650° F. (343° C.). Heavy oil feedstreams as described herein may also include a blend of the hydrocarbons listed above with lighter hydrocarbon streams, such as, but not limited to, distillates, kerosene, or light naphtha diluents, and/or synthetic crudes, for control of certain properties desired for the transport or sale of the resulting hydrocarbon blend, such as, but not limited to, transport or sale as fuel oils and crude blends. In preferred embodiments of the present invention, the heavy oil feedstream contains at least 60 wt % hydrocarbon compounds, and more preferably, the heavy oil feedstream contains at least 75 wt % hydrocarbon compounds.

The sulfur content of the heavy oil feedstream can contain at least about 0.5 wt % sulfur, preferably at least about 1 wt % sulfur, and more preferably at least about 3 wt % sulfur. In other embodiments, the heavy oil feedstream can contain polycyclic sulfur heteroatom complexes which are difficult to desulfurize by conventional methods.

Alkali Metal Salt Reagent

In various embodiments, an alkali metal salt can be used as a reagent in a desulfurization process. In order to use the alkali metal salt as a reagent, the alkali metal salt can be mixed into the heavy oil feedstream as an aqueous solution. The mixture of heavy oil and aqueous alkali metal salt solution can then be partially, substantially, or completely dehydrated to produce a heavy oil feedstream containing alkali metal salt particles.

Preferably, the alkali metal can be potassium. In alternative embodiments, other alkali metals can be used, such as sodium, lithium, cesium, or rubidium. The alkali metal can be in the form of a salt, such as a sulfide or a hydroxide. Preferably, the alkali metal salt reagent can be KOH, $K_2S$, or a combination thereof. More preferably, the alkali metal salt reagent is KOH. Note that in embodiments involving a sulfide, species such as KHS that also include a hydrogen may be present, although these are believed to be not preferred due to a lower activity for sulfur removal. Mixtures of alkali metals in a reagent are also possible, such as NaKS.

In an embodiment, the alkali metal salt can be introduced into the heavy oil feed as an aqueous stream. Preferably, the aqueous stream of alkali metal salt can be a roughly or nearly saturated solution of alkali metal salt in water. The solubility of alkali metal salts in water is dependent on the type of salt. For example, KOH is soluble up to about 50 wt % KOH in an aqueous solution.

The aqueous alkali metal salt solution can be combined with the full heavy oil feed. Alternatively, the alkali metal salt solution can be mixed with a side stream of the feed. Mixing of the heavy oil and the aqueous stream can be facilitated using a static or dynamic mixer to obtain a dispersion of droplets of the aqueous phase. Preferably, a majority of the volume of the aqueous phase is included in droplets having a droplet size of less than about 1 mm, preferably less than about 0.7 mm, and more preferably less than about 0.4 mm.

After mixing of the aqueous alkali metal salt solution and the heavy oil, it is preferred if most of the water is removed from the mixture prior to sending the mixture to the conversion reactors. Preferably, the water is removed from the mixture by heating the mixture. One method for removing the water is to heat the mixture to a temperature of at least about 150° C. and then separating at least a part of the water in the mixture from the hydrocarbons in a flash drum. The mixture can be heated up to temperatures of at least about 250° C., or even at least about 275° C. However, preferably, the temperature for removing the water is about 310° C. or less, or more preferably about 300° C. or less. The temperature can be selected so that the temperature is high enough to substantially remove the water while being low enough so that little or no reaction occurs between alkali metal salt reagent and the sulfur in the heavy oil.

Alkali Metal Salt Desulfurization Reaction

After removing water, the mixture of alkali metal reagent stream and heavy oil can be introduced into a suitable reactor. Herein, the desulfurization reactor can be comprised of a vessel or even simply piping which provides sufficient contact time and conditions for a desired level of desulfurization of the hydrocarbon portion of the overall process stream. A hydrogen-containing stream may optionally be added to an alkali metal desulfurization reaction. If a hydrogen-containing stream is utilized, it is preferred that the hydrogen-containing stream contain at least 50 mol % hydrogen, more preferably at least 75 mol % hydrogen. When hydrogen is utilized in the process, it is preferred that the hydrogen partial pressure in the heavy oils desulfurization reactor be from about 100 to about 2500 psi (689 to 17,237 kPa). At these partial pressures, the hydrogen assists in the reaction process by removing at least a portion of the sulfur in the hydrocarbons via conversion to the alkali metal hydrosulfide, which may, but is not required to, go through a hydrogen sulfide, $H_2S$ intermediate. Hydrogen sulfide that is formed in the first reaction zone can also react with the alkali metal hydroxides donating some of the sulfur and forming alkali metal hydrosulfides and alkali metal sulfides thereby improving the overall sulfur removal in the process. Excess hydrogen also assists in hydrogenating the broken sulfur bonds in the hydrocarbons and increasing the hydrogen saturation of the resulting desulfurized hydrocarbon compounds.

Although only one reactor need be utilized, in preferred embodiments of the invention, two or more reactors are used as desulfurization reactors. A separator can be included after each reactor to remove contaminants, such as $H_2S$ or water vapor that forms during the reaction. Another potential advantage of using two or more reactors is that the conditions in the reactors can be controlled separately. For example, the first of two reactors can be set at more severe conditions. Based on the design of the reactor, the holding time in the first reactor can correspond to a first period of time that is less than the desired total reaction time. The partially reacted feed can then be passed to a second reactor zone at a less severe reaction condition, such as reactor at a lower temperature. By limiting the amount of time the heavy oil spends under more severe conditions, a desired level of desulfurization and/or conversion can be achieved, while reducing the amount of undesired coke production.

Suitable desulfurization conditions in a heavy oils desulfurization reactor can include temperatures from about 600° F. to about 900° F. (316° C. to 482° C.), preferably about 650° F. to about 875° F. (343° C. to 468° C.), and more preferably about 700° F. to about 850° F. (371° C. to 454° C.). Suitable reaction pressures can be from about 50 to about 3000 psi (345 to 20,684 kPa), preferably about 200 to about 2200 psi (1,379 to 15,168 kPa), and more preferably about 500 to about 1500 psi (3,447 to 10342 kPa). In a preferred embodiment, the contact time of the heavy oils feedstream and the alkali metal hydroxide stream in the heavy oils desulfurization reactor can be about 5 to about 720 minutes, preferably about 30 to about 480 minutes, and more preferably 60 to about 240 minutes. It is noted that a suitable contact time can be dependent upon the physical and chemical characteristics of the hydrocarbon stream including the sulfur content and sulfur species of the hydrocarbon stream, the amount of sulfur to be removed, and the molar ratio of the alkali metal reagent used in the process to the sulfur present in the heavy oils feedstream.

The amount of alkali metal salt reagent mixed with the heavy oil feed can be selected based on the sulfur content of the feed. In an embodiment, the amount of alkali metal salt, on a moles of alkali metal versus moles of sulfur basis, can be at least about 1.2 times the amount of sulfur in the feed, or at least about 1.4 times, or at least about 1.5 times. Alternatively, the amount of alkali metal salt can be about 2.5 times the amount of sulfur or less, or about 2 times or less, or about 1.75 times or less. In another embodiment, the weight of the alkali metal salt particles in the hydrocarbon heavy oil feed can be at least about 1 wt %, or at least about 5 wt %, or at least about 7.5 wt %, or at least about 10 wt %, or at least about 15 wt %, at least about 20 wt %, or at least about 25 wt % based on the weight of the hydrocarbon feed. Alternatively, the weight of alkali metal salt particles can be about 30 wt % or less, or about 25 wt % or less, or about 20 wt % or less, or about 15 wt % or less based on the weight of the hydrocarbon feed.

In an embodiment where multiple reactors are used and where the reaction conditions are different in each reactor, the second reactor can have a temperature that is at least about 5° C. cooler than the first reactor, or at least about 10° C. cooler, or at least about 20° C. cooler. In another embodiment, the pressure in the second reactor can be at least about 100 kPa lower, or at least about 250 kPa lower. In these embodiments, the second reactor is utilized more to trim the overall desulfurization while minimizing the impacts of instable solubility due to excess cracking.

However, in different embodiments where multiple reactors are used and where the reaction conditions are different in each reactor, the second reactor can have a temperature that is at least about 5° C. higher than the first reactor, or at least about 10° C. higher, or at least about 20° C. higher. In another embodiment, the pressure in the second reactor can be at least about 100 kPa higher, or at least about 250 kPa higher. In these embodiments, the first reactor utilized for milder hydrotreating and primary product separation, and the second reactor, especially when hydrogen is added in between the two reactor stages, is utilized at higher severity on the bottoms product from the first reactor for producing a higher desulfurized final product.

In preferred embodiments, the type and/or configuration of the desulfurization reactor can be selected to facilitate proper mixing and contact between the heavy oil feedstream and the alkali metal reagent stream. Examples of preferred reactor types include slurry reactor or ebullating bed reactor designs. Additionally, static, rotary, or other types of mixing devices can be employed in the feed lines to heavy oils desulfurization reactor, and/or mixing devices can be employed in the heavy oils desulfurization reactor to improve the contact between the heavy oil feedstream and the alkali metal reagent stream. Still other devices that can be employed include heaters and/or drying drums.

In embodiments involving a desulfurization process, the sulfur content of the desulfurized hydrocarbon product stream can be less than about 40% of the sulfur content by weight of the heavy oils feedstream. In a more preferred embodiment of the present invention, the sulfur content of the desulfurized hydrocarbon product stream is less than about 25% of the sulfur content by weight of the heavy oils feedstream. In a most preferred embodiment of the present invention, the sulfur content of the desulfurized hydrocarbon product stream is less than about 10% of the sulfur content by wt % of the heavy oils feedstream. These parameters are based on water-free hydrocarbon streams.

Separation of Conversion Products and Coke Removal

After the conversion/desulfurization reactors, the products from the reactor(s) are then passed to a vapor separator. This initial separation in the vapor separator is preferably conducted at a reduced pressure (i.e., lower than the pressure of the last conversion reactor). The product stream from the reactor(s) may also be optionally cooled prior to entering the vapor separator. The vapor separation produces a liquids bottoms stream that includes the spent alkali metal reagent and the heavier portions of the desulfurized oil. The vapor portion from the vapor separator includes naphtha (or a "naphtha fraction"), distillate, and $C_4$ or lighter hydrocarbons as well as $H_2$ that can be recycled. In the discussion below, "$C_4$ or lighter hydrocarbons" refer to hydrocarbons with 4 or fewer carbons, such as butane, butene, propane, methane, etc. Note that performing this separation at an elevated temperature reduces losses of $H_2$ due to dissolution in the bottoms fraction.

The "naphtha" or "naphtha fraction" herein is characterized by its boiling end points which are the temperatures at which 5 wt % of the stream will boil (T5 boiling point) and at which 95 wt % of the stream will boil (T95 boiling point). As utilized herein, a "naphtha" or "naphtha fraction" is any hydrocarbon-containing fraction that has a T5 boiling point of at least 25° C. (77° F.) and a T95 boiling point of less than 235° C. (455° F.). In a preferred embodiment herein, at least a portion of the naphtha fraction obtained can be mixed back into the final desulfurized oil products obtained after waster washing.

The vapor product from the above separation can then be passed through a cooling stage to produce a cooled liquid and a cooled vapor. Preferably, the cooled liquid can be a distillate boiling range fraction, while the vapor or "low-boiling point fraction" can include naphtha and light distillate boiling range fractions as well as other low boiling hydrocarbons and hydrogen. Both the liquid and/or the vapor can optionally be subjected to a hydrotreatment step in order to saturate olefins within the fractions.

The liquids bottoms stream, which includes the spent alkali metal reagent and the heavier portions of the desulfurized oil, is obtained from the bottom of the vapor separator which is then sent to a series of one or more wash water separators. Preferably, additional water is added to the bottoms stream prior to the mixed stream being sent to the first separator. The addition of water will help to separate the desulfurized oil from the spent alkali metal reagents, especially if the reagents are water soluble. The added water will also help to create an emulsion phase which is important to the invention herein. It is further preferred if a mixer is utilized on the bottoms stream after the additional water injection but prior to the first wash water separator to assist in proper removing the spent alkali salts into an aqueous phase as well as assisting in producing an emulsion phase in the subsequent wash water separator vessel(s).

After forming a desulfurized heavy oil product, the spent alkali metal can be separated from the desulfurized oil present in the liquids bottoms stream. For example, if KOH is used as an alkali metal salt reagent, the resultant KHS and $K_2S$ products formed, as well as any excess KOH can be separated from the desulfurized heavy oil product. If $K_2S$ is present in the desulfurized oil, the $K_2S$ can convert into KOH and KHS when exposed to water from the water wash step. Preferably, the separation process can remove ~99.9% of the potassium from the desulfurized product. In such an embodiment where a desulfurization reaction is performed with a reagent treat rate of 15 wt %, this would result in a desulfurized product containing about 150 ppm potassium or less.

In addition to alkali metal reagent that becomes spent directly due to desulftuzation, a portion of the alkali metal reagent can be consumed through formation of other species, such as $K_2CO_3$. The amount of alkali carbonate formed during desulfurization can vary, and can account for up to a third of the alkali metal consumed during a desulfurization process.

In the wash water separator(s), it is preferred if the liquids bottoms stream, which includes the spent alkali metal reagent and the heavier portions of the desulfurized oil, as well as added water be allowed sufficient residence time in the water wash separator to allow the stream to separate into three distinct phases. It is referred if velocities in the water wash separator are below 0.50 ft/sec, more preferably less than 0.25 ft/sec, even more preferably less than about 0.10 ft/sec to allow these three distinct phases to separate in the wash water separator. The water wash vessel may also be equipped with laminar flow internals and/or electric grids to assist in the coalescence and separation of the water phase particles in the stream from the other two phases. Optionally, commercial emulsifying agents may be added to the liquids bottoms stream to assist in forming an emulsion layer in the wash water separator(s). If emulsifying agents are utilized, it is preferred that they are added to the liquids bottoms stream upstream of the optional mixer element noted prior.

The reaction conditions for separating the alkali metal salt from the desulfurized oil can be temperatures and pressures that are convenient for the other stages of the regeneration process. The separation conditions can include a temperature of at least about 120° C., or at least about 135° C., or at least about 150° C. The separation pressure can be at least about 100 psig (690 kPa), or at least about 200 psig (1379 kPa), or at least about 300 psig (2068 kPa), or at least about 350 psig (2413 kPa).

In the present invention, in the wash water separator(s) the liquid input is allowed to settle into three distinct phases. It has been discovered herein, that an intermediate "emulsion phase" forms between a primarily "oil phase" (containing primarily the desulfurized oil components) and a primarily "aqueous phase" (containing primarily the water and the spent alkali metal salts reagents) which can be drawn off the water wash separator vessels as a separate stream. It has further been discovered herein that this emulsion phase contains a very significant amount of the overall coke produced in the alkali metals conversion reaction processes. In prior art embodiments, this emulsion phase is either not produced or recognized, and it was not known that such an emulsion phase can be produced and drawn off separately from the oil and spent metal products thereby removing the majority of the produced coke byproducts from the product streams. In the present invention, besides removing the separate intermediate emulsion phase with the majority of the coke byproducts from the wash water separators, at least one separated desulfurized oil stream and at least one aqueous phase spent alkali metal stream are removed from at least one wash water separator vessel. The term "emulsion phase" as used herein may also be referred to herein as the "interface level" or "rag layer" or similar such terms.

In the invention herein is provided a very simple and eloquent manner in which removing the majority of the coke byproducts from the alkali metal salt reaction processes. Additionally, the total emulsion phase is expected to be less than 10% or even less than 5% of the total volume of the products in the water wash vessel(s), thus making methods for filtering and/or disposal of the coke much more cost effective (i.e., reduced overall volumes). This also minimizes the amount of lost converted product oil and/or lost alkali metal salts than if the coke would need to be separately removed from either or both of these separated product streams. As will be seen in the examples herein in preferred embodiments of the invention, at least 50 wt %, more preferably at least 75 wt %, and even more preferably at least 85 wt % of the total coke produced in the alkali metal reaction process(es) herein are removed in the emulsion phase streams(s) produced in the processes herein.

In preferred embodiments, at least a portion of the emulsion phase stream is sent to a water treatment plant for further processing. In another preferred embodiment, at least a portion of the emulsion phase stream is sent to a refiner Coker unit, mixed with the coker feedstream, heated, and then sent to a coker drum to separate the coke from the mixture of the emulsion phase stream and coker feedstream.

In an embodiment herein, the wash water separator vessel(s) are fitted with a least one, preferably multiple, intermediate level withdrawal nozzle for withdrawing the emulsion phase interface from the separator vessel. A simplified schematic of an embodiment illustrating this configuration is shown in FIG. 1, wherein the wash water separator 100 is equipped with at least one interface nozzle 105 for drawing off the emulsion phase layer 110. Please note that although not fully illustrated, the feed to the separator vessel 100 enters on the left hand side of the vessel and as the feed moves from left to right in the vessel, a separate emulsion phase layer 110 begins to form in the vessel with a separate desulfurized oil product above it and a separate aqueous spent alkali metal product above it in the vessel. As can be seen in FIG. 1, the water wash separator 100 is further equipped with at least one nozzle for drawing off a desulfurized oil product stream 115, and at least one nozzle for drawing off an aqueous spent alkali metal stream 120.

Figure 2:
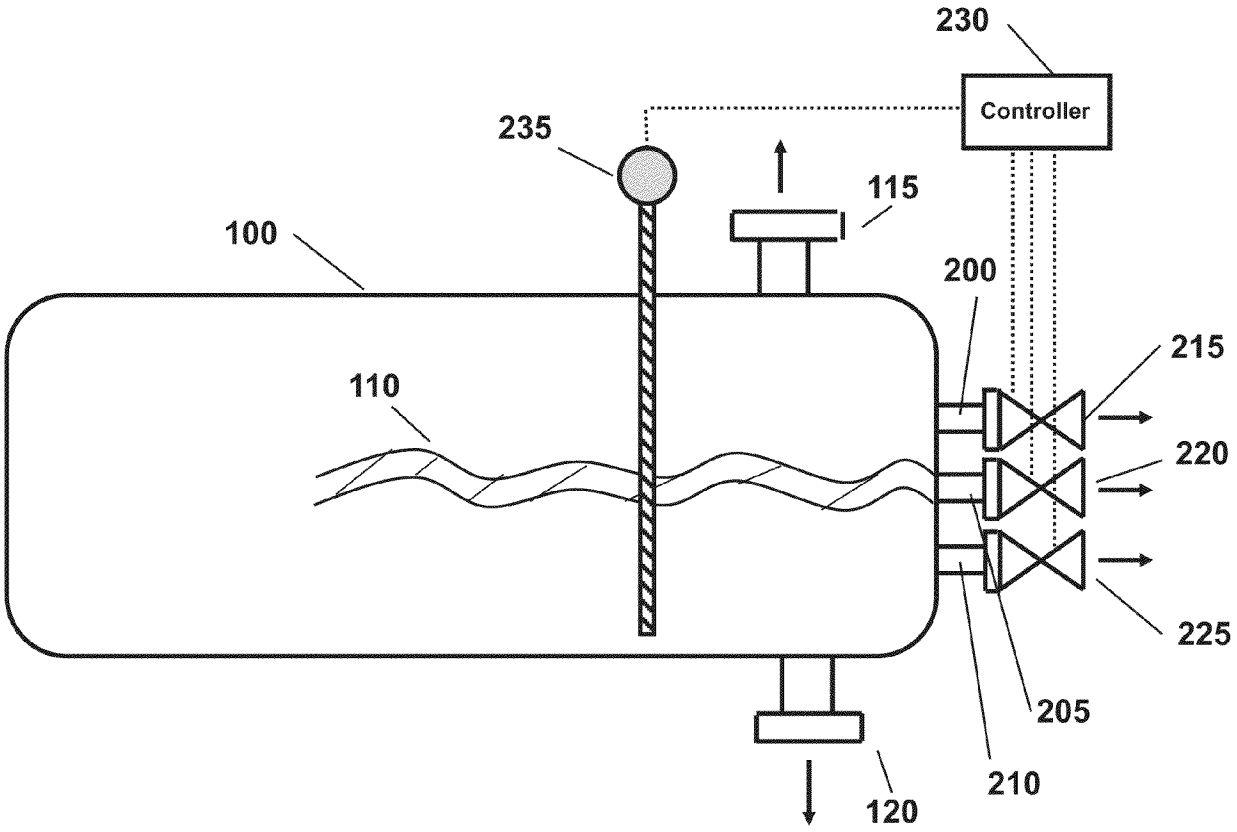
FIG. 2 illustrates a preferred embodiment of a wash water separator vessel and multiple draw nozzles arrangement of invention with integrated level controls for removing a separate desulfurized oil layer, aqueous spent alkali metal layer, and emulsion phase layer from the separator vessel.

FIG. 2 illustrates another preferred embodiment of a wash water vessel configuration utilized in the processes of the present invention. Here, multiple intermediate level withdrawal nozzles (shown as 200, 205, and 210) are installed on the wash water separator 100 which are preferably connected to a single collection header (not shown). In this manner, the emulsion layer 110 in the vessel can be allowed to "float" at different elevations in the wash water vessel and drawn off appropriately. The valves (shown as 215, 220, and 225) can either be manually controlled, preferably with the aid of a sight level glass (not shown) on the wash water vessel 100, or more preferably, the valves (shown as 215, 220, and 225) are automated control valves which operations are controlled via a separate controller 230 that receives level signals for the location of the emulsion layer from an interface level detector 235. Preferably, the interface level indicator is selected from a conductivity probe or a specific gravity displacement probe. As can be seen in FIG. 2, the water wash separator 100 is further equipped with at least one nozzle for drawing off a desulfurized oil product stream 115, and at least one nozzle for drawing off an aqueous spent alkali metal stream 120.

Figure 3:
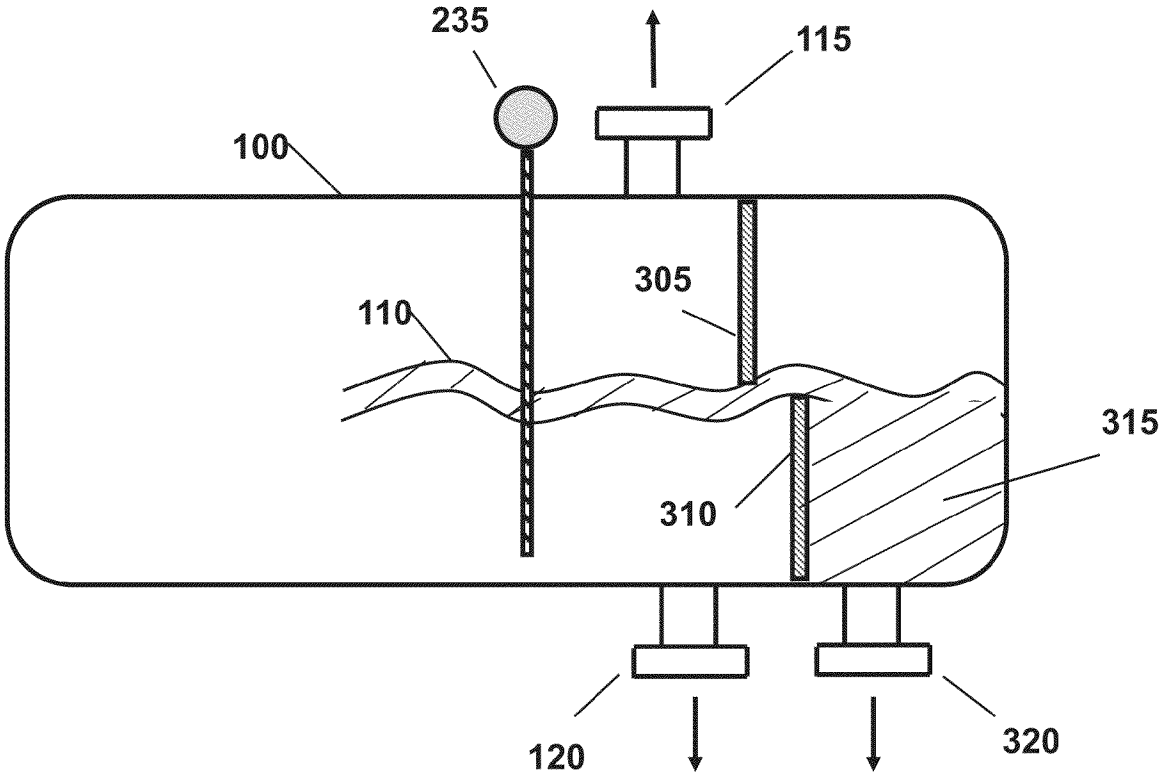
FIG. 3 illustrates a preferred embodiment of a wash water separator vessel with internals and controls designed for removing a separate desulfurized oil layer, aqueous spent alkali metal layer, and emulsion phase layer from the separator vessel.

FIG. 3 illustrates an embodiment wherein the wash water separator vessel 100 is equipped with a coupled internal underflow weir 305 and overflow weir 310. The weirs are located (or can be adjusted) so that the vertical overlap between the two weirs is at the level of emulsion layer 110. The emulsion layer 110 herein is allowed to accumulate in an emulsion layer well 315 located in a segmented end of the wash water separator 100 as shown in FIG. 3. The accumulated emulsion phase in the emulsion layer well 315 can then be drawn off via emulsion draw nozzle 320. Here, the water wash separator vessel 100 is further equipped with at least one nozzle for drawing off a desulfurized oil product stream 115, and at least one nozzle for drawing off an aqueous spent alkali metal stream 120. It is preferred in this embodiment that the water wash separator vessel be equipped with an interface level detector 235 which receives level signals for the location of the emulsion layer 110 and is utilized to control either the flow to the water wash vessel, or more preferably, the desulfurized product stream flow and aqueous spent alkali metal stream flow from the water wash vessel in order to maintain the emulsion phase layer 110 at the appropriate height of the weir interface.

Desulfurization Products

Preferably, the desulfurized and converted oil product has an API of at least 20, or at least 21, or at least 23. Preferably, the viscosity of the desulfurized and converted oil product is about 40 cst or less at 40° C. Alternatively, the viscosity can be about 350 cst or less at a temperature of about 7.5 to 18.5° C.

After a desulfurization reaction, the alkali metal salt reagent can become spent. For example, a KOH or $K_2S$ reagent can react with sulfur from a feed to form spent KHS. The KHS is a lower activity species that can be regenerated to form either KOH or $K_2S$. Any suitable regeneration method can be used. For example, an ion exchange process could be used to convert KIN into KOH. Electrolysis could also be used to convert KHS into KOH.

Preferably, regeneration can be accomplished using $CO_2$ and CaO. The $CO_2$ can be used to convert KHS into $K_2CO_3$. This can be exchanged with CaO to form $CaCO_3$ and KOH.

Examples of Reaction System Configuration

Figure 4:
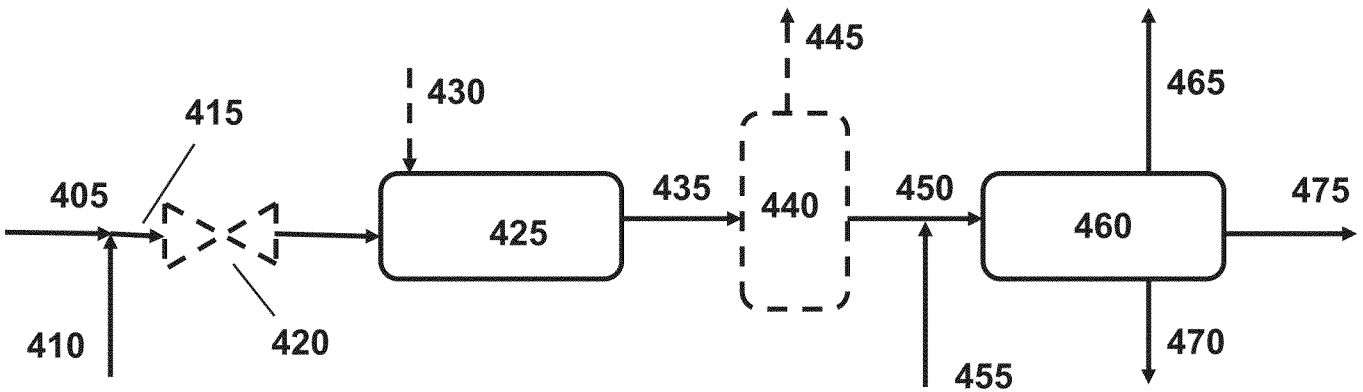
FIG. 4 illustrates a preferred embodiment of process of invention wherein at least one desulfurization reactor and at least one wash water separator of design are utilized.

FIG. 4 schematically shows an example of a reaction system for performing an embodiment of the invention. FIG. 4 illustrates a preferred embodiment of the present invention wherein an alkali metal reagent treatment single reactor system and single water wash vessel is utilized. It should be noted that FIG. 4 as presented herein is a simplified flow diagram, only illustrating one possible embodiment of the major processing equipment components and major process streams. It should be clear to one of skill in the art that additional equipment components and auxiliary streams may be utilized in the actual implementation of the invention as described.

In the embodiment shown in FIG. 4, a heavy oils stream 405 is mixed with an alkali metal reagent stream 410 to form a mixed reactor feed stream 415. Here, an optional mixer 420 as described in the specification may be used to ensure proper contact of the alkali metal reagent and the heavy oil that is to be desulfurized/converted.

The mixed reactor feedstream is sent to a desulfurization reactor 425. Preferably, but optionally, a hydrogen-containing stream 430 is added to the desulfurization reactor 425.

Alternatively (not shown in FIG. 4), some or all of the hydrogen-containing stream can be added to the mixed reactor feedstream 415 upstream of the desulfurization reactor 425.

The desulfurization reactor 425 produces a reaction product stream 435 comprised of lower boiling point converted compounds, a desulfurized heavy oil component, a spent alkali metal reagent component and coke (high carbon content solids). Preferably, the lower boiling point components of the reaction product stream 435 are removed prior to sending the reaction products to the wash water vessel 460. FIG. 4 shows this optional configuration, wherein the reaction product stream 435 is sent to a vapor separator 440 wherein the lower boiling point components 445 are removed from the reaction product stream 435. The desulfurized liquid reaction product stream 450 containing the spent alkali metal compounds and coke is then mixed with additional water 455 prior to sending this mixed stream to the wash water vessel 460. In all embodiments herein, the desulfurized liquid reaction product stream(s) possess a lower sulfur content by wt % than the original hydrocarbon feedstream to the processes.

The lower boiling point compounds in stream 445 can include distillate, naphtha, $C_4$ and smaller hydrocarbons, unreacted hydrogen, and contaminant gases such as $H_2S$ that formed during desulfurization. These various fractions can be further separated out to allow for recovery of the hydrogen. The distillate and naphtha fractions can optionally undergo some processing, such as hydrotreatment.

In the wash water vessel 460, the desulfurized liquid reaction product stream 450 is separated into three distinct phases as discussed in detail herein. These three phases appear as layers within the wash water vessel 460. The top layer is a desulfurized oil product stream 465 which is removed from the top of the vessel and the bottom layer is an aqueous spent metal reagent stream 470 which is removed from the bottom of the vessel. In between these top and bottom layers exists an interface layer or emulsion phase layer 475 which is drawn of the wash water vessel separately from the desulfurized oil product stream 465 and the aqueous spent metal reagent stream 470. As noted prior, this small amount of the emulsion phase layer 475 has been found to contain well over 50% of the coke formed in the reaction process. This stream is generally considerably lower in volume than either the desulfurized oil product stream 465 or the aqueous spent metal reagent stream 470 and can be sent for recovery and/or disposal within the refinery preferably by either sending the recovered emulsion layer back the refinery crude feed system or sending the recovered emulsion layer to a coking unit where the coke can be recovered and disposed of or sold.

Figure 5:
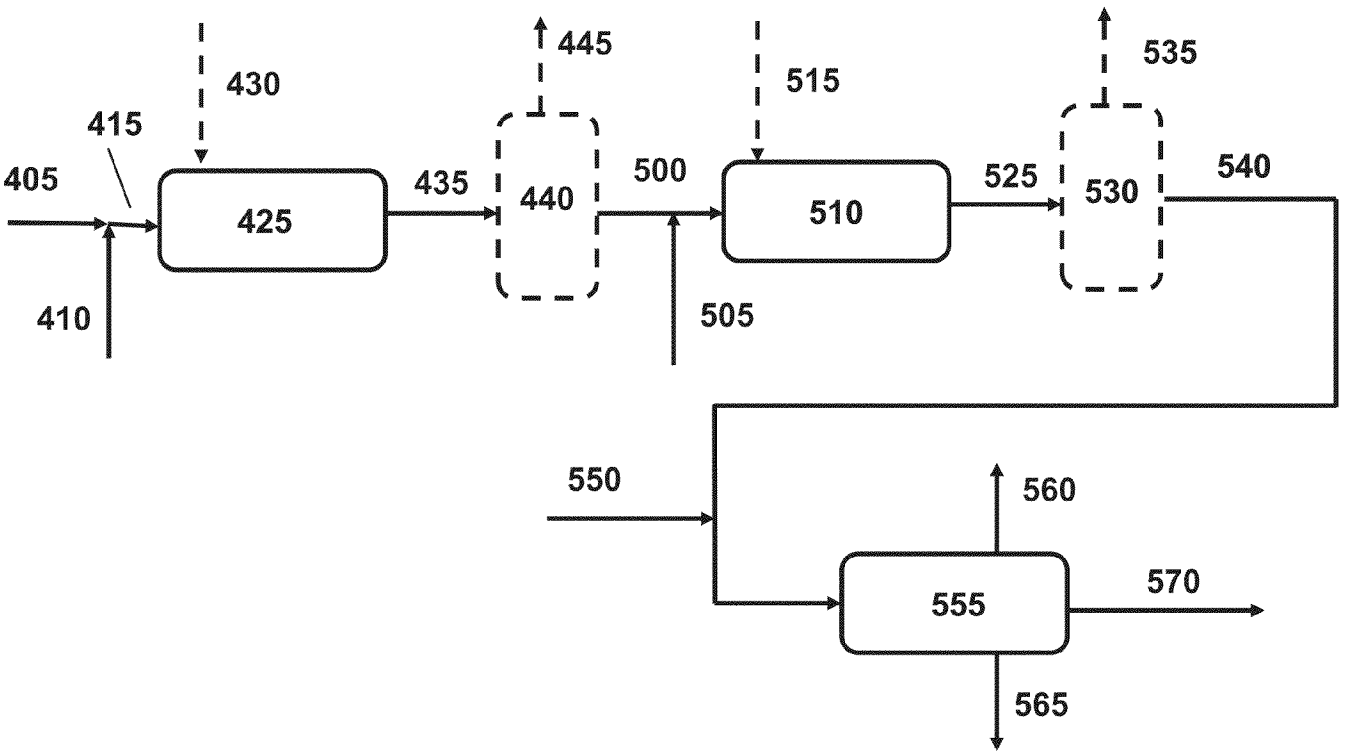
FIG. 5 illustrates a preferred embodiment of process of invention wherein at least two desulfurization reactors and at least one wash water separator of design are utilized.

Another preferred embodiment is illustrated in FIG. 5. Here, elements 405 through 445 are essentially similar to those described above for the embodiment of FIG. 4 except, for simplicity purposes, the optional mixer 420 is not illustrated. Here, a the first desulfurized reaction product stream 500 from the first vapor separator 440 is further mixed with an additional second alkali metal reagent stream 505 to form a second mixed reactor feed stream which is sent to a second desulfurization reactor 510. Preferably, but optionally, a hydrogen-containing stream 515 is added to the second desulfurization reactor 510. Alternatively (not shown in FIG. 5), some or all of the hydrogen-containing stream can be added to the mixed reactor feedstream upstream of the second desulfurization reactor 510.

The second desulfurization reactor 510 produces a second reaction product stream 525 comprised of lower boiling point converted compounds, a desulfurized heavy oil component, a spent alkali metal reagent component and coke (high carbon content solids). Preferably, the lower boiling point components of the second reaction product stream 525 are removed prior to sending the reaction products to the wash water separator vessel 555. FIG. 5 shows this optional configuration, wherein the second reaction product stream 525 is sent to a second vapor separator 530 wherein a second lower boiling point components stream 535 is removed from the second reaction product stream 525. The second desulfurized liquid reaction product stream 540 containing the spent alkali metal compounds and coke is then mixed with additional water 550 prior to sending this mixed stream to the wash water vessel 555.

In the wash water separator vessel 555, the second desulfurized liquid reaction product stream 540 is separated into three distinct phases as discussed in detail herein. These three phases appear as layers within the wash water vessel 555. The top layer is a desulfurized oil product stream 560 which is removed from the top of the vessel and the bottom layer is an aqueous spent metal reagent stream 565 which is removed from the bottom of the vessel. In between these top and bottom layers exists an interface layer or emulsion phase layer 570 which is drawn off the wash water vessel separately from the desulfurized oil product stream 560 and the aqueous spent metal reagent stream 565. As noted prior, this small amount of the emulsion phase layer 570 has been found to contain well over 50% of the coke formed in the reaction process. This stream is generally considerably lower in volume than either the desulfurized oil product stream 560 or the aqueous spent metal reagent stream 565 and can be sent for recovery and/or disposal within the refinery preferably by either sending the recovered emulsion layer back the refinery crude feed system or sending the recovered emulsion layer to a coking unit where the coke can be recovered and disposed of or sold.

Figure 6:
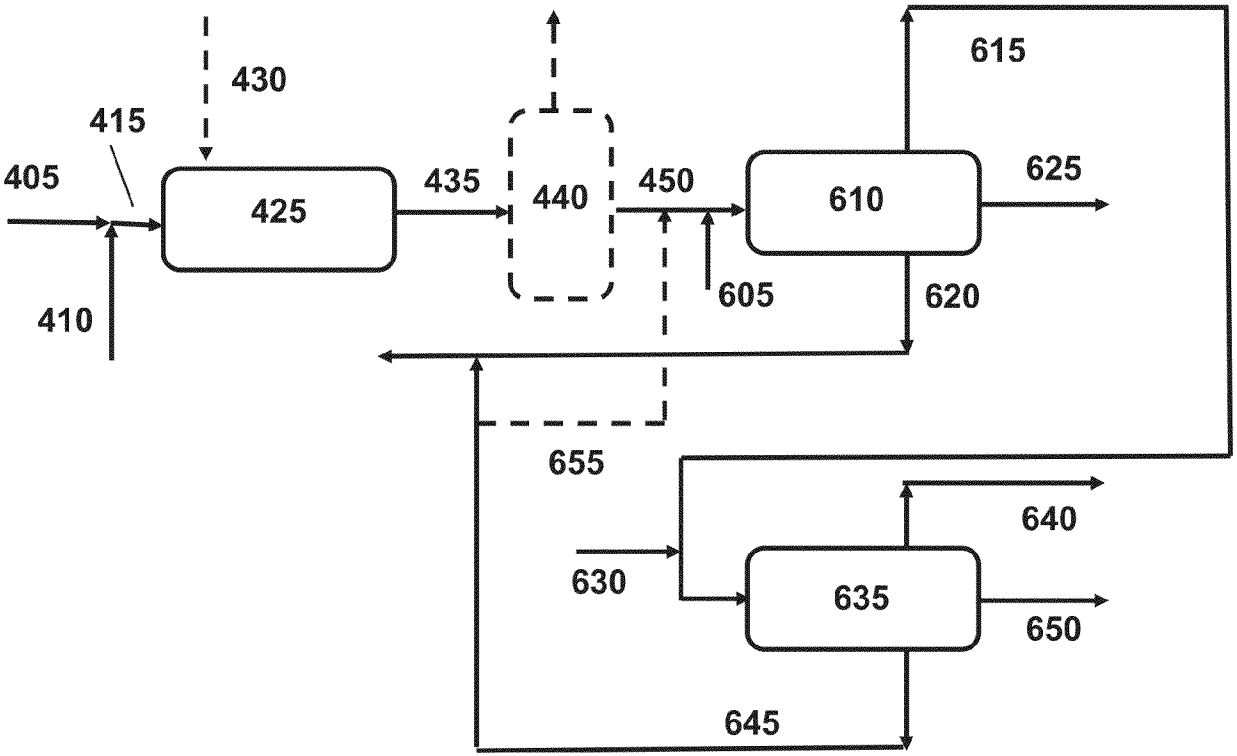
FIG. 6 illustrates a preferred embodiment of process of invention wherein at least one desulfurization reactor and at least two wash water separators of design are utilized.

FIG. 6 illustrates yet another preferred embodiment of the present invention wherein at least two wash water vessels are utilized in a "cross-flow" configuration. This embodiment allows for improved separation of the desulfurized oil phase, the aqueous alkali metal phase and the emulsion phase, thus ensuring higher purity of each of the desulfurized oil phase and the aqueous alkali metal phase, as well as maximizing the percentage of coke that is removed via the emulsion phase. While FIG. 6 is illustrated with only a single reactor, it is clear to one of skill in the art that the invention may be used in a multiple reactor configuration, such as illustrated by the embodiment of FIG. 5 herein. Additionally, although the embodiment is FIG. 6 is illustrated with only two wash water vessel, it is clear to one of skill in the art that the invention may be used with more than two wash water vessels, preferably in a cross-flow arrangement as shown in FIG. 6 and/or a parallel water wash configuration.

Returning to FIG. 6, elements 405 through 450 are essentially similar to those described above for the embodiment of FIG. 4, except for simplicity purposes, the optional mixer 420 is not illustrated. Here, the desulfurized liquid reaction product stream 450 containing the spent alkali metal compounds and coke is then mixed with additional water 605 prior to sending this mixed stream to the first wash water separator vessel 610. In the first wash water vessel 610, the desulfurized liquid reaction product stream 450 is separated into three distinct phases as discussed in detail herein. These three phases appear as layers within the first wash water vessel 610. The top layer is a first desulfurized oil product stream 615 which is removed from the top of the vessel and the bottom layer is a first aqueous spent metal reagent stream 620 which is removed from the bottom of the vessel. In between these top and bottom layers exists a first interface layer or first emulsion phase layer 625 which is drawn off the first wash water vessel separately from the first desulfurized oil product stream 615 and the first aqueous spent metal reagent stream 620. As noted prior, this small amount of the first emulsion phase layer 625 drawn off from the first water wash vessel contains a very high percentage of coke relative to the first desulfurized oil product stream 615 and the first aqueous spent metal reagent stream 620 components, as well as preferably greater than 50% of the coke formed in the reaction process. The first emulsion phase layer 625 is generally considerably lower in volume than either the first desulfurized oil product stream 615 or the first aqueous spent metal reagent stream 620 and can be sent for recovery and/or disposal within the refinery as noted prior.

Continuing with the embodiment as shown in FIG. 6, the first desulfurized oil product stream 615 which still may contain small amounts of spent alkali metal compounds and coke is then mixed with additional water 630 prior to sending this mixed stream to a second wash water vessel 635. Similar to the conditions in the first wash water vessel 610, in the second wash water vessel 635 the first desulfurized reaction product stream 615 is separated into three distinct phases within the second wash water vessel 635. The top layer is a second desulfurized oil product stream 640 which is removed from the top of the vessel and the bottom layer is a second aqueous spent metal reagent stream 645 which is removed from the bottom of the vessel. In between these top and bottom layers exists a second interface layer or second emulsion phase layer 650 containing a significant amount of coke byproducts from the conversion reaction and which is drawn off of the second wash water vessel separately from both the second desulfurized oil product stream 640 and the second aqueous spent metal reagent stream 645 components. This second emulsion phase layer stream 650 can be disposed of in a similar manner as discussed for the first emulsion phase layer stream 625 and the emulsion streams optionally may be combined for further processing and/or disposal.

Additionally, the first aqueous spent metal reagent stream 620 and the second aqueous spent metal reagent stream 645 may be combined and sent to an alkali metal recovery process and the recovered/converted alkali metal reagents may be sent back to the process via stream 410. In an optional preferred embodiment herein, at least a portion of the second aqueous spent metal reagent stream 655 is combined with the desulfurized reaction product stream 450 prior to send the mixture to the first water wash vessel 610.

EXAMPLE

In this Example, thirteen (13) lab scale experiments were made reacting potassium salts (either KOH, $K_2S$, or combinations thereof) with a bitumen at conversion reaction conditions and then allowing the liquid reaction products to separate. The experiments herein involved the thermal cracking of bitumen derived oils in the presence of either KOH or $K_2S$. The laboratory work was conducted in a stirred tin bath autoclave at reaction temperatures from 600° F. to 800° F. (typically 700° F. to 750° F.). These reactions were run under a continuous flow of hydrogen, with a hydrogen partial pressure of typically 1000 psi. These reactions were conducted with 100 g of heavy feed oil and various amounts of K-salt. The reactions were run at reaction times up to several hours (typically about 30 to 90 minutes). At the end of the reaction, the products were first physically removed from the reactor and then the remaining was removed by solvents. The process demonstrated 1050° F.+ conversions up to 70% with 70 to 75 wt % sulfur removal.

Figure 7:
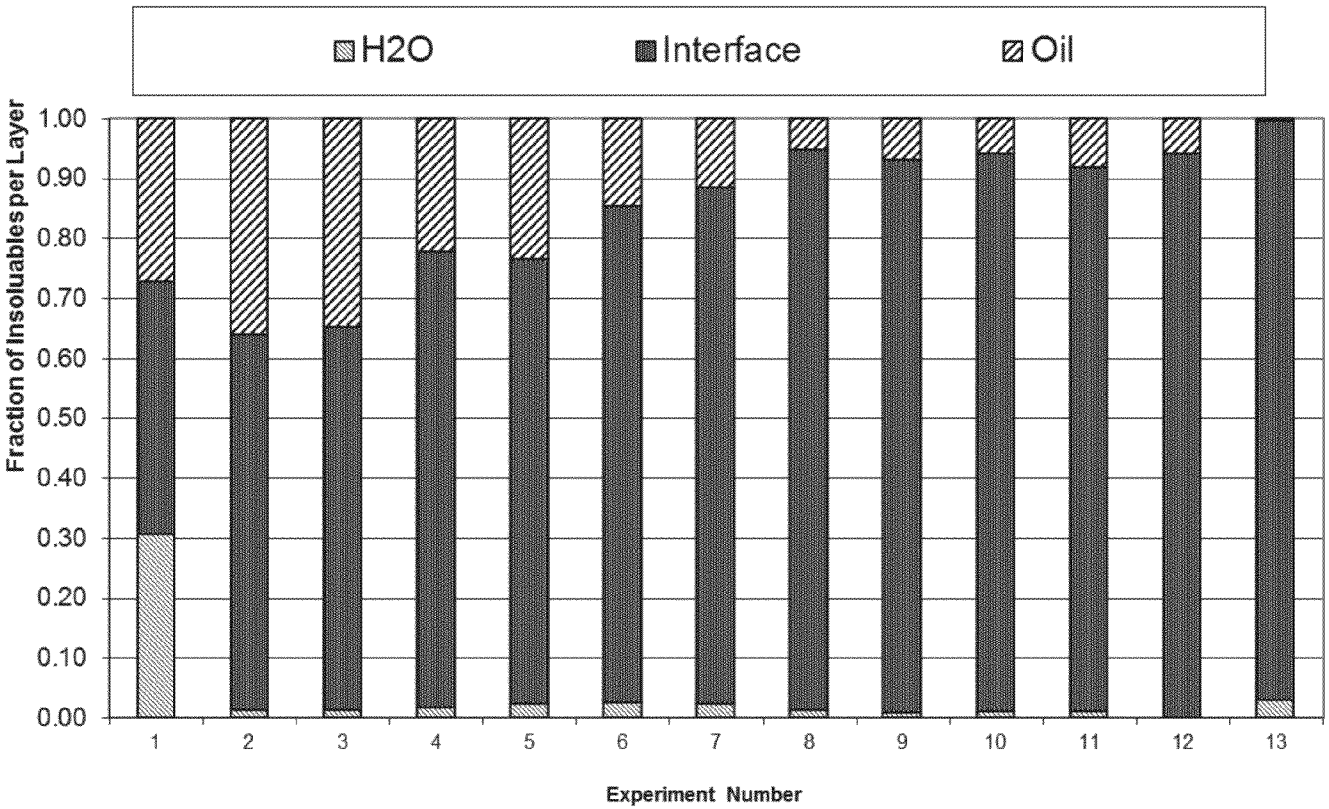
FIGS. 7, 8, 9, and 10 graphically present various test results from the Example herein.

The results from these experiments are shown in FIG. 7 and are oriented from left to right in order of increasing percentage of product coke that was in the interfacial emulsion layer. In each of the thirteen (13) bars in FIG. 7, the bottom most portion of the bar shows the amount of insolubles (coke) that was filtered from the water phase; the next highest portion of the bar shows the amount of insolubles (coke) that was filtered from the emulsion phase; and the next highest portion of the bar shows the amount of insolubles (coke) that was filtered from the oil phase.

As can be seen, it was discovered herein that the amount of the total coke byproducts that was able to be removed from the process products via withdrawal of the emulsion layer ranged from over 40 wt % of the total coke byproducts produced in the reaction process to over 95 wt % of the total coke byproducts produced.

Figure 8:
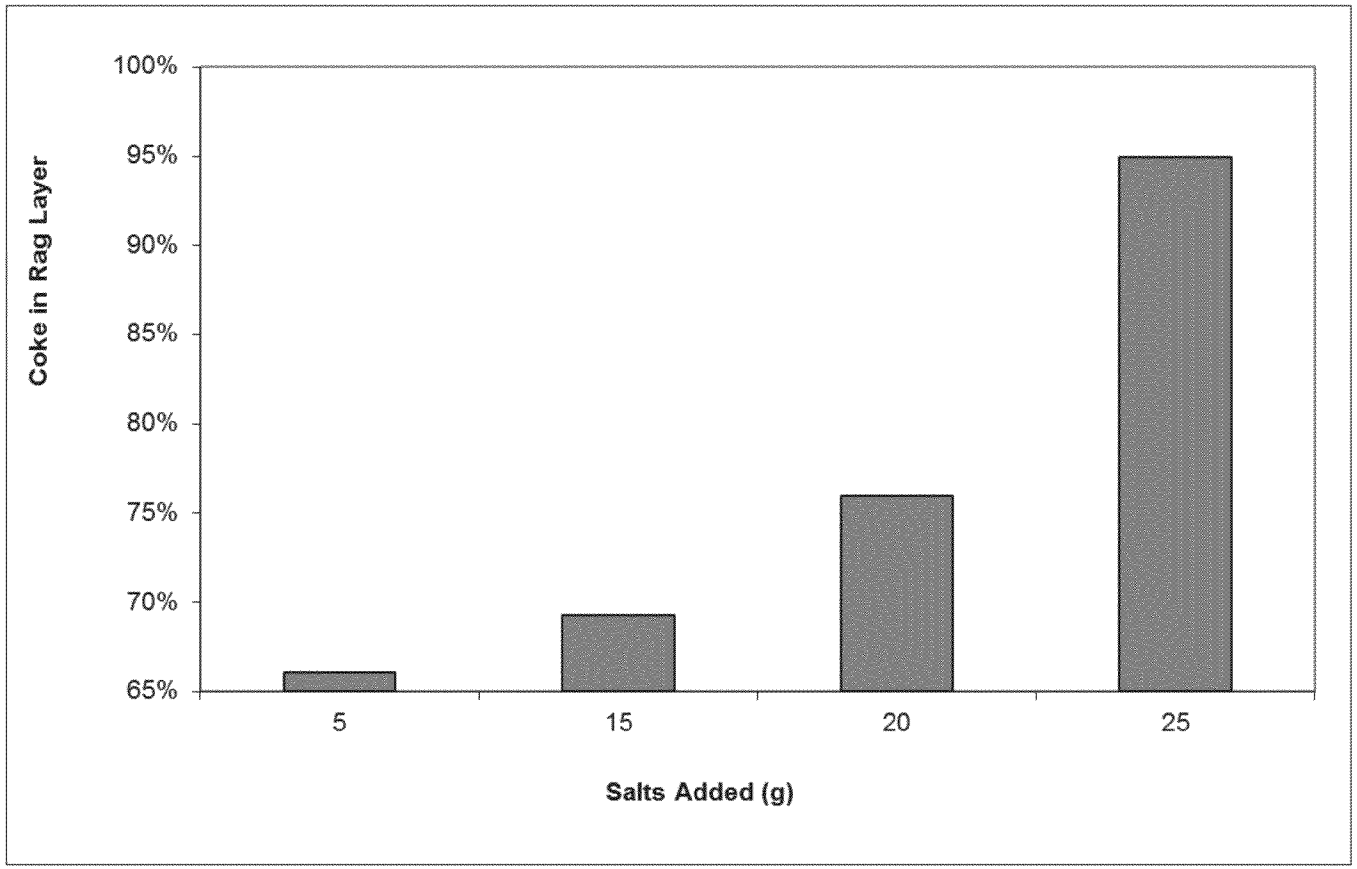
Figure 9:
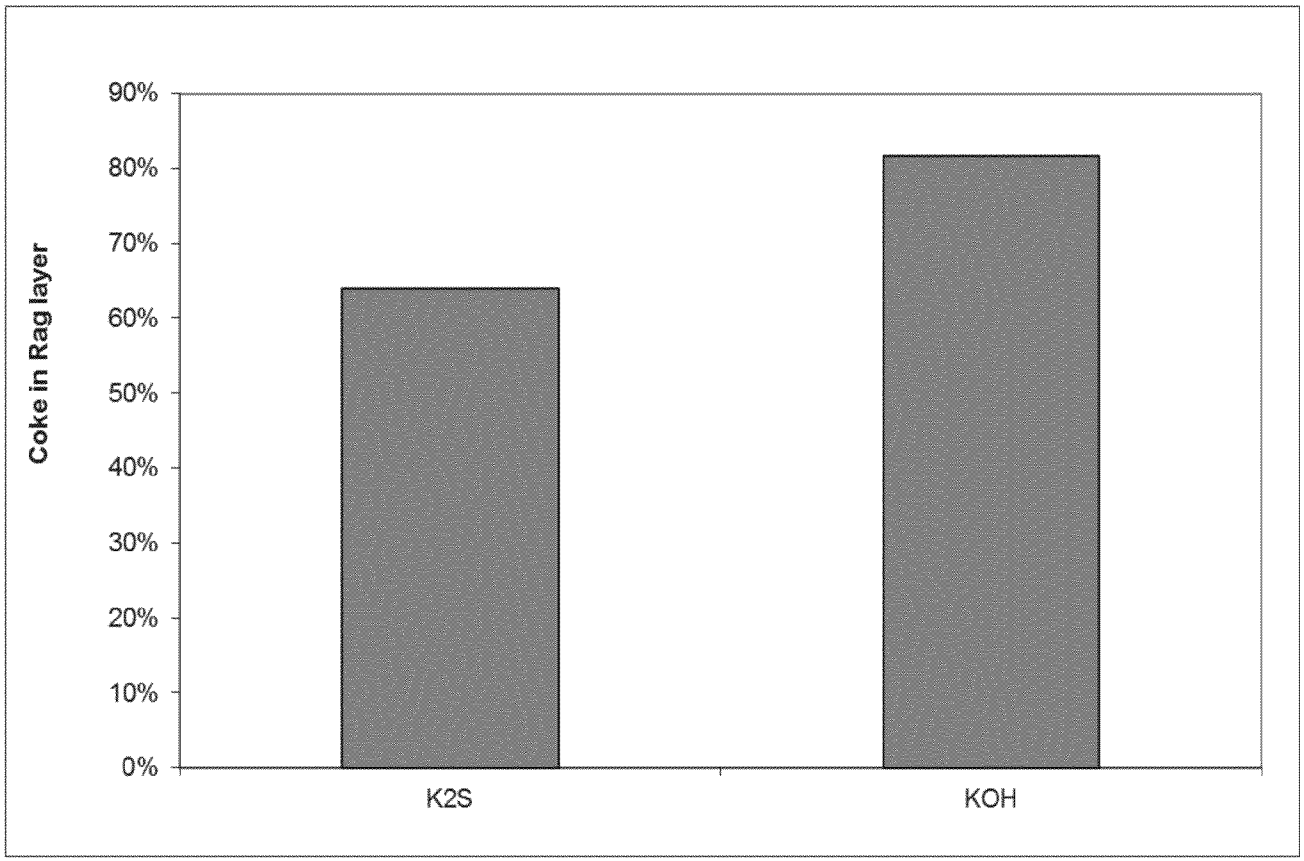

The data from these tests was also reviewed in terms of the amount of coke in the emulsion layer as a function of the concentration of alkali salt added in the conversion reaction process. These results are shown graphically in FIG. 8. It was discovered herein that the amount of coke that was able to be retrieved via the emulsion layer (shown as "rag layer" in FIGS. 8-10) was a function of the concentration of the alkali salts added to the process. It can be seen at alkali salt concentrations of at least about 15 wt % based on the weight of the hydrocarbon feed (i.e., 20 g alkali salt added to 100 g oil), that over 75 wt % of the total coke products were deposited in to the resulting emulsion layer. At alkali salt concentrations of at least about 20 wt % based on the weight of the hydrocarbon feed (i.e., 25 g alkali salt added to 100 g oil), that over 95 wt % of the total coke products were deposited in to the resulting emulsion layer. Higher salt concentrations resulted in higher byproduct coke removal via the process of invention. It should be noted that these results shown in FIG. 8 are independent of the total coke present in the produced reaction streams.

The data from these tests was also reviewed in terms of the amount of coke in the emulsion layer as a function of the type of alkali salt added in the conversion reaction process. This is shown graphically in FIG. 9. Here, it shows that the alkali metal hydroxides result in a higher percentage of coke in the emulsion layer than when alkali metal sulfides are used as the alkali metal reagent.

Figure 10:
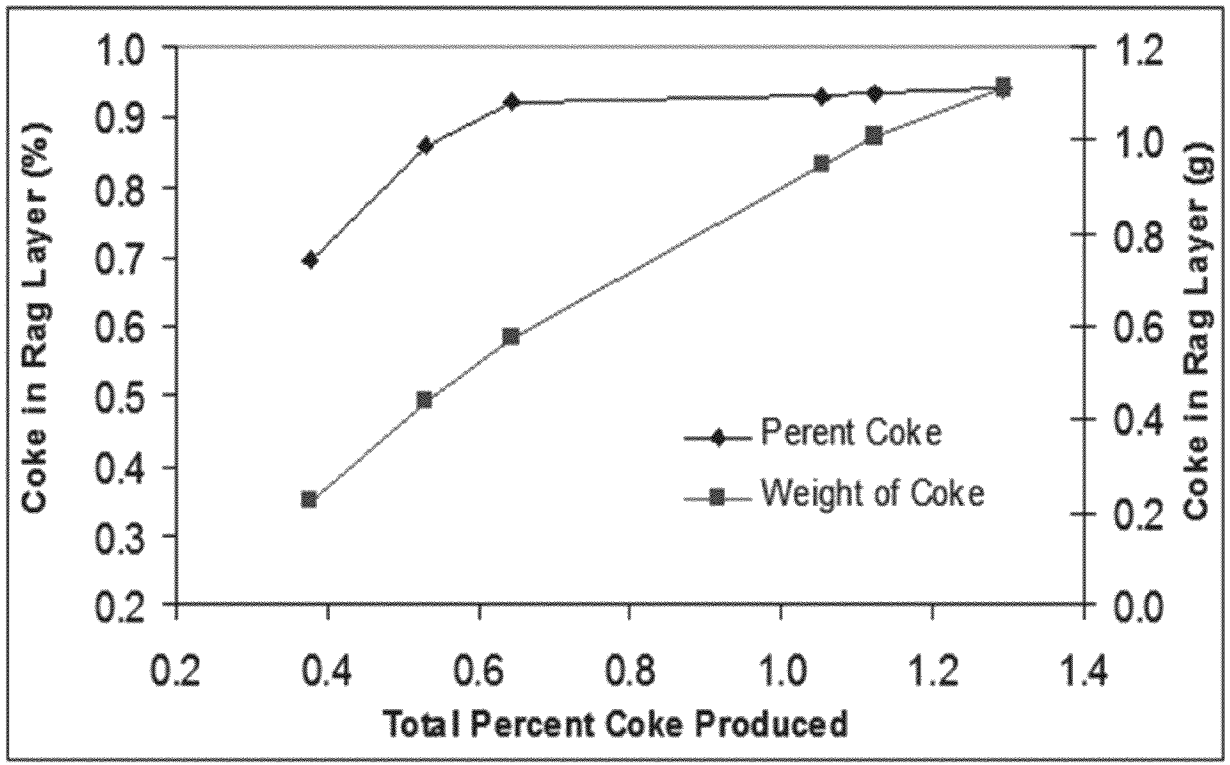

FIG. 10 illustrates another important factor discovered in the present invention. Here, the data from the tests show that the percentage of coke that can be extracted via the emulsion layer increases as the amount of total coke make increases. This is a very surprising and beneficial discovery. It is known that the higher severity at which the conversion/desulfurization process is run, the higher the amount of coke that is produced as an unwanted byproduct. However, here it is shown that at these higher severities (higher coke make), the process works even more efficiently than at lower severity rates. That is, the higher level of undesired coke is produced in the reaction, the more efficient the present invention operates in removing the produced coke. A resulting benefit of this discovery is that with the present invention, the alkali metal conversion processes can higher severities (which results in higher conversion to more valuable products), while the amount of coke that is not captured in the emulsion phase may remain about the same. That is, with the present invention, higher severities (Which result in higher total coke byproducts) do not result in significantly increased coke contamination of either the desulfurized oil or spent alkali metal streams, as the process of invention (i.e., extracting the coke via the emulsion layer) actually becomes more efficient at these higher coke levels.

What is claimed is:

1. A process for desulfurizing a hydrocarbon feedstream, comprising:

a) mixing at least a portion of a hydrocarbon feedstream having an API gravity of less than 19 with an aqueous alkali metal salt reagent solution to form a first mixed reactor feedstream;

b) exposing at least a portion of the first mixed reactor feedstream to a first desulfurization reactor operated under first effective desulfurization conditions to form a first desulfurized reactor product stream comprising desulfurized oil, spent alkali metals, and coke;

c) separating the first desulfurized reactor product stream to form at least a first low-boiling point vapor fraction and a first reactor product liquid fraction;

d) mixing at least a portion of the first reactor product liquid fraction with water to form a first wash water separator feedstream;

e) sending the first wash water separator feedstream to a first wash water separator vessel wherein in the first wash water separator vessel, the first wash water separator feedstream forms three distinct layers as flows: a first desulfurized oil product layer, a first emulsion phase layer, and a first aqueous spent alkali metal layer;

f) removing each of the three distinct layers separately from the first wash water separator vessel to separately form a first desulfurized oil product stream, a first emulsion phase stream, and a first aqueous spent alkali metal stream;

wherein at least 50 wt % of the total coke in the first desulfurized reactor product stream is removed in the first emulsion phase stream, and the first desulfurized oil product stream has a lower sulfur content by wt % than the hydrocarbon feedstream, and the first desulfurized oil product stream has a API gravity of at least 20 and a viscosity of less than or equal to 40 centistokes at 40° C.

2. The process of claim 1, further comprising:

heating the first mixed reactor feedstream to a temperature of at least 150° C.;

sending the heated first mixed reactor feedstream through a mixing device; and removing at least at least a portion of the water from the first mixed reactor feedstream prior to step b).

3. The process of claim 1, wherein the alkali metal salt reagent solution comprises an alkali metal sulfide, an alkali metal hydrogen sulfide, an alkali metal hydroxide, or a combination thereof.

4. The process of claim 3, wherein the alkali metal salt reagent solution comprises $K_2S$, KHS, KOH or a mixture thereof.

5. The process of claim 4, wherein the alkali metal salt reagent solution comprises KOH.

6. The process of claim 5, wherein the first aqueous spent alkali metal stream comprises $K_2S$, KHS, KNaS or a mixture thereof.

7. The process of claim 1, wherein the first effective desulfurization conditions are from about 50 to about 3000 psi (345 to 20,684 kPa), and from about 600° F. to about 900° F. (316° C. to 482° C.).

8. The process of claim 1, wherein the first low-boiling point vapor fraction is comprised of a first naphtha fraction, wherein the first naphtha fraction has a T5 boiling point greater than 25° C. (77° F.) and a T95 boiling point less than 235° C. (455° F.).

9. The process of claim 8, wherein at least a portion of the first naphtha fraction is combined with the first desulfurized oil product stream.

10. The process of claim 1, wherein a hydrogen-containing stream, comprised of at least 75 mol % hydrogen is added to the first mixed reactor feedstream either prior to or in the first desulfurization reactor.

11. The process of claim 1, wherein the amount of alkali metal salt (on an alkali metal molar basis) in the aqueous alkali metal salt reagent solution is at least 1.2 times the amount of sulfur (on a sulfur molar basis) of the hydrocarbon feedstream.

12. The process of claim 1, wherein the hydrocarbon feedstream is a heavy oil feedstream having a sulfur content of at least about 3 wt %.

13. The process of claim 1, wherein at least 75 wt % of the total coke generated in step b) is removed in the first emulsion phase stream.

14. The process of claim 13, wherein the amount of alkali metal salt in the first mixed reactor feedstream is at least about 20 wt % of the hydrocarbon feedstream.

15. The process of claim 1, wherein at least 95 wt % of the total coke generated in step b) is removed in the first emulsion phase stream, and the amount of alkali metal salt in the first mixed reactor feedstream is at least about 25 wt % of the hydrocarbon feedstream.

16. The process of claim 1, wherein at least a portion of the first emulsion phase stream is further processed, the steps comprising:

sending at least a portion of the first emulsion phase stream to a refinery Coker unit;

mixing the first emulsion phase stream with a coker feed stream to form mixed coker feed stream;

heating the mixed coker feedstream;

sending the mixed coker feedstream to a coker drum; and separating at least a portion of the coke that was in the first emulsion phase stream from the mixed coker feedstream.

17. The process of claim 1, wherein the first wash water separator vessel comprises an interface level detector selected from a conductivity probe and a specific gravity displacement probe.

18. The process of claim 17, wherein the first wash water separator vessel has more than one draw nozzles equipped with automated control valves for the first emulsion phase layer which are located at different elevations on the first wash water separator vessel and the output from interface level detector is further connected to a controller which sends at least one output to each automated control valves for controlling the flow of the first emulsion phase stream from the first wash water separator vessel.

19. The process of claim 17, wherein the first wash water separator vessel is further comprised of at least one set of internal underflow/overflow weirs for separating the first emulsion phase layer from the first desulfurized oil product layer and first aqueous spent alkali metal layer.

20. A process for desulfurizing a hydrocarbon feedstream, comprising:

a) mixing at least a portion of a hydrocarbon feedstream having an API gravity of less than 19 with a first aqueous alkali metal salt reagent solution to form a first mixed reactor feedstream;

b) exposing at least a portion of the first mixed reactor feedstream to a first desulfurization reactor operated under first effective desulfurization conditions to form a first desulfurized reactor product stream comprising desulfurized oil, spent alkali metals, and coke;

c) separating the first desulfurized reactor product stream to form at least a first low-boiling point vapor fraction and a first reactor product liquid fraction;

d) mixing at least a portion of the first reactor product liquid fraction with a second aqueous alkali metal salt reagent solution to form a second mixed reactor feedstream;

e) exposing at least a portion of the second mixed reactor feedstream to a second desulfurization reactor operated under second effective desulfurization conditions to form a second desulfurized reactor product stream comprising desulfurized oil, spent alkali metals, and coke;

f) separating the second desulfurized reactor product stream to form at least a second low-boiling point vapor fraction and a second reactor product liquid fraction;

g) mixing at least a portion of the second reactor product liquid fraction with water to form a first wash water separator feedstream;

h) sending the first wash water separator feedstream to a first wash water separator vessel wherein in the first wash water separator vessel, the first wash water separator feedstream forms three distinct layers as flows: a first desulfurized oil product layer, a first emulsion phase layer, and a first aqueous spent alkali metal layer;

i) removing each of the three distinct layers separately from the first wash water separator vessel to separately form a first desulfurized oil product stream, a first emulsion phase stream, and a first aqueous spent alkali metal stream;

wherein at least 50 wt % of the total coke in the first and second desulfurized reactor product streams is removed in the first emulsion phase stream, and the first desulfurized oil product stream has a lower sulfur content by wt % than the hydrocarbon feedstream, and the first desulfurized oil product stream has a API gravity of at least 20 and a viscosity of less than or equal to 40 centistokes at 40° C.

21. The process of claim 20, wherein the alkali metal salt reagent solutions comprise an alkali metal sulfide, an alkali metal hydrogen sulfide, an alkali metal hydroxide, or a combination thereof.

22. The process of claim 21, wherein the alkali metal salt reagent solutions comprise $K_2S$, KHS, KOH or a mixture thereof.

23. The process of claim 22, wherein the alkali metal salt reagent solutions comprise KOH.

24. The process of claim 23, wherein the aqueous spent alkali metal streams comprise $K_2S$, KHS, KNaS or a mixture thereof.

25. The process of claim 20, wherein the first and second effective desulfurization conditions are from about 50 to about 3000 psi (345 to 20,684 kPa), and from about 600° F. to about 900° F. (316° C. to 482° C.).

26. The process of claim 20, wherein a first hydrogen-containing stream, comprised of at least 75 mol % hydrogen is added to the first mixed reactor feedstream either prior to or in the first desulfurization reactor and a second hydrogen-containing stream, comprised of at least 75 mol % hydrogen is added to the second mixed reactor feedstream either prior to or in the second desulfurization reactor.

27. The process of claim 20, wherein the amount of alkali metal salt (on an alkali metal molar basis) in the first aqueous alkali metal salt reagent solution is at least 1.2 times the amount of sulfur (on a sulfur molar basis) of the hydrocarbon feedstream.

28. The process of claim 20, wherein the hydrocarbon feedstream is a heavy oil feedstream having a sulfur content of at least about 3 wt %.

29. The process of claim 20, wherein at least 75 wt % of the total coke in the first and second desulfurized reactor product streams is removed in the first emulsion phase stream, and the amount of alkali metal salt in the first mixed reactor feedstream is at least about 20 wt % of the hydrocarbon feedstream.

30. The process of claim 20, wherein at least 95 wt % of the total coke in the first and second desulfurized reactor product streams is removed in the first emulsion phase stream, and the amount of alkali metal salt in the first mixed reactor feedstream is at least about 25 wt % of the hydrocarbon feedstream.

31. A process for desulfurizing a hydrocarbon feedstream, comprising:

a) mixing at least a portion of a hydrocarbon feedstream having an API gravity of less than 19 with an aqueous alkali metal salt reagent solution to form a first mixed reactor feedstream;

b) exposing at least a portion of the first mixed reactor feedstream to a first desulfurization reactor operated under first effective desulfurization conditions to form a first desulfurized reactor product stream comprising desulfurized oil, spent alkali metals, and coke;

c) separating the first desulfurized reactor product stream to form at least a first low-boiling point vapor fraction and a first reactor product liquid fraction;

d) mixing at least a portion of the first reactor product liquid fraction with water to form a first wash water separator feedstream;

e) sending the first wash water separator feedstream to a first wash water separator vessel wherein in the first wash water separator vessel, the first wash water separator feedstream forms three distinct layers as flows: a first desulfurized oil product layer, a first emulsion phase layer, and a first aqueous spent alkali metal layer;

f) removing each of the three distinct layers separately from the first wash water separator vessel to separately form a first desulfurized oil product stream, a first emulsion phase stream, and a first aqueous spent alkali metal stream;

g) mixing at least a portion of the first desulfurized oil product stream with water to form a second wash water separator feedstream h) sending the second wash water separator feedstream to a second wash water separator vessel wherein in the second wash water separator vessel, the second wash water separator feedstream forms three distinct layers as flows: a second desulfurized oil product layer, a second emulsion phase layer, and a second aqueous spent alkali metal layer;

i) removing each of the three distinct layers separately from the second wash water separator vessel to separately form a second desulfurized oil product stream, a second emulsion phase stream, and a second aqueous spent alkali metal stream;

wherein at least 50 wt % of the total coke in the first desulfurized reactor product stream is removed in the first and second emulsion phase streams, and the first and second desulfurized oil product streams each have a lower sulfur content by wt % than the hydrocarbon feedstream, and the first and second desulfurized oil product streams each have an API gravity of at least 20 and a viscosity of less than or equal to 40 centistokes at 40° C.

32. The process of claim 31, wherein the alkali metal salt reagent solution comprises an alkali metal sulfide, an alkali metal hydrogen sulfide, an alkali metal hydroxide, or a combination thereof.

33. The process of claim 32, wherein the alkali metal salt reagent solution comprises $K_2S$, KHS, KOH or a mixture thereof.

34. The process of claim 33, wherein the first and second aqueous spent alkali metal streams comprise $K_2S$, KHS, KNaS or a mixture thereof.

35. The process of claim 31, wherein the first effective desulfurization conditions are from about 50 to about 3000 psi (345 to 20,684 kPa), and from about 600° F. to about 900° F. (316° C. to 482° C.), and a hydrogen-containing stream, comprised of at least 75 mol % hydrogen is added to the first mixed reactor feedstream either prior to or in the first desulfurization reactor.

36. The process of claim 31, wherein the amount of alkali metal salt (on an alkali metal molar basis) in the alkali metal salt reagent solution is at least 1.2 times the amount of sulfur (on a sulfur molar basis) of the hydrocarbon feedstream.

37. The process of claim 31, wherein the hydrocarbon feedstream is a heavy oil feedstream having a sulfur content of at least about 3 wt %.

38. The process of claim 31, wherein at least 75 wt % of the total coke in the first desulfurized reactor product stream is removed in the first and second emulsion phase streams, and the amount of alkali metal salt in the first mixed reactor feedstream is at least about 20 wt % of the hydrocarbon feedstream.

39. The process of claim 31, wherein at least 95 wt % of the total coke in the first desulfurized reactor product stream is removed in the first and second emulsion phase streams, and the amount of alkali metal salt in the first mixed reactor feedstream is at least about 25 wt % of the hydrocarbon feedstream.

40. The process of claim 31, wherein at least a portion of the first and second aqueous spent alkali metal streams are combined, the alkali metal salts are regenerated, and at least a portion of the regenerated alkali metal salts are contacted with the hydrocarbon feedstream, and wherein at least a portion of the second aqueous spent alkali metal stream is contacted with the first desulfurized oil product stream.

* * * * *